US007603972B2

(12) United States Patent
Han et al.

(10) Patent No.: US 7,603,972 B2
(45) Date of Patent: Oct. 20, 2009

(54) CYLINDER DEACTIVATION SYSTEM FOR VEHICLE AND VARIABLE VALVE LIFT SYSTEM USING THE SAME

(75) Inventors: Dong Hee Han, Seoul (KR); Woo Tae Kim, Suwon-si (KR); In Gee Suh, Yongin-si (KR); Hyung Ick Kim, Gunpo-si (KR); Back Sik Kim, Osan-si (KR); Dae Sung Kim, Hwaseong-si (KR)

(73) Assignee: Hyundai Motor Company, Seoul (KR)

( * ) Notice: Subject to any disclaimer, the term of this patent is extended or adjusted under 35 U.S.C. 154(b) by 371 days.

(21) Appl. No.: 11/648,760

(22) Filed: Dec. 29, 2006

(65) Prior Publication Data

US 2008/0083385 A1 Apr. 10, 2008

(30) Foreign Application Priority Data

Oct. 10, 2006 (KR) ..... 10-2006-0098270
Dec. 1, 2006 (KR) ..... 10-2006-0120396

(51) Int. Cl.
*F01L 1/34* (2006.01)

(52) U.S. Cl. ..... 123/90.16; 123/90.15; 123/90.39

(58) Field of Classification Search ..... 123/90.15, 123/90.16, 90.39
See application file for complete search history.

(56) References Cited

U.S. PATENT DOCUMENTS 5,394,841 A * 3/1995 Murakami ..... 123/90.15
5,623,897 A * 4/1997 Hampton et al. ..... 123/90.16

FOREIGN PATENT DOCUMENTS

| | | |
|---|---|---|
| JP | 1986-118904 | 7/1986 |
| JP | 05-033619 | 2/1993 |
| JP | 08-028235 | 1/1996 |
| JP | 11-013441 | 1/1999 |
| JP | 2001-152821 | 6/2001 |

* cited by examiner

*Primary Examiner*—Zelalem Eshete
(74) *Attorney, Agent, or Firm*—Morgan, Lewis & Bockius LLP

(57) ABSTRACT

A cylinder deactivation system for a vehicle and a variable valve lift system is fabricated with an end pivot structure that can control two valves at the same time. The structure ensures reliability since a latching pin does not receive a shear force and provides an excellent assemblage and a cost reduction by minimizing the number of parts Such a cylinder deactivation system may include a rocker shaft having an oil supply hole, a rocker arm, a middle arm, and a latching portion separating the rocker arm from the middle arm when an oil pressure operates through the oil supply hole.

13 Claims, 6 Drawing Sheets

CYLINDER DEACTIVATION SYSTEM FOR VEHICLE AND VARIABLE VALVE LIFT SYSTEM USING THE SAME

CROSS-REFERENCE TO RELATED APPLICATION

This application claims the benefits of Korean Patent Application Nos. 10-2006-0098270 and 10-2006-0120396, filed on Oct. 10, 2006 and Dec. 1, 2006, respectively, the contents of which are hereby incorporated herein by reference in their entirety.

BACKGROUND OF THE INVENTION

1. Field of the Invention

The present invention relates to a cylinder deactivation system for a vehicle and a variable valve lift system using the same and, more particularly, to a cylinder deactivation system fabricated with an end pivot structure that can control two valves at the same time.

2. Description of Related Art

Recently, numerous techniques aimed at improving fuel efficiency of a gasoline vehicle using a variable valvetrain have been applied due to the increase in oil prices. A cylinder deactivation system, one of the numerous variable valvetrain techniques, is a technique that deactivates a portion of unnecessary cylinders according to the load of engine, thus reducing the pumping and the friction loss.

To efficiently apply a cylinder deactivation system, it is necessary to provide a device for completely eliminating the valve lifts of the respective deactivated cylinders and such a device should satisfy the following functions and requirements: (1) A change between a common cam and a zero lift cam should be practicable; (2) The change between the common cam and the zero lift cam should be completed within one cycle of engine; (3) There should not be imposed mechanical compulsions and excessive forces upon the valve change; (4) Strength and durability of proper levels should be provided; and (5) A valve clearance should be maintained.

Cylinder deactivation systems have been mass-produced and applied mainly to the large displacement engines, such as V8 or V6. However, existing systems can have a number of drawbacks. For example, some systems are suitable to the push rod type engine, but not applicable to an over head cam (OHC) type; rather, it has characterized properties to an over head valve (OHV) type. Other structures using sliding pin connections have a drawback in that if the oil pressure is applied to separate the sliding pin, a load occurs in the return spring of the opposite pin, thus causing a sliding-contact continuously. Another device for the swing arm type requires that a latching system should be established to the respective valves.

SUMMARY OF THE INVENTION

Embodiments of the present invention provide a cylinder deactivation system for a vehicle that satisfies the above requirements and improves the engine performance by adopting a newly-designed latching portion, mounted on an end pivot type rocker arm, which controls two valves at the same time in a four-vale engine, and on a middle arm, to vary the valve lifts when an engine rotates at low speed and at high speed, and a variable valve lift system using the same.

In an exemplary embodiment of the present invention, there is provided a cylinder deactivation system, the system comprising: a rocker shaft having an oil supply hole; a rocker arm, of which the rear portion is hinge-connected with the rocker shaft so that the front portion thereof drives a valve; a middle arm, in which a bearing is mounted in the front portion thereof so that a cam is rolling-contacted and the rear end thereof is hinge-connected with the rocker shaft; and a latching portion separating the rocker arm from the middle arm when an oil pressure operates through the oil supply hole.

As a further exemplary embodiment, a hollow portion is formed inside the rocker shaft to allow the oil to flow and the oil supply hole is established on the rocker shaft, to which the middle arm is hinge-connected.

As another exemplary embodiment, the rocker arm is established at both sides thereof in parallel at a fixed interval to operate two valves and the front bottom of the rocker arm is connected with a U-shaped connecting bracket.

Moreover, the latching portion, installed on the bottom of the bearing in the front end of the middle arm, for allowing the middle arm and the rocker arm to operate separated from each other or to operate in a body by the oil pressure.

Furthermore, the latching portion comprises: a spring support portion inserted into the bottom of the bearing mounted in the front end of the middle arm and including a projection projected forward; a return spring penetrated and supported by the projection; and a latching pin, of which the rear portion is supported elastically by the return spring and the front portion is curved from both ends of the rear portion in the forward direction.

In addition, the front portion of the latching pin is formed curvedly and a protruding portion is formed in the middle of the rear portion thereof in the vertical direction.

Moreover, the oil pressure operates through the oil supply hole and an oil groove, of which one end is interconnected with the oil supply hole on the inner circumferential surface of the rear portion of the middle arm and the other end is formed inclinedly so that the oil is supplied from the one end to the front of the protruding portion of the latching pin.

Furthermore, the rocker arm includes a hinge portion formed to be hinge-connected with the rocker shaft, a valve contact portion, of which the front portion is formed to drive the valve, and a zero lift pad established between the hinge portion and the valve contact portion to maintain a valve clearance if there is no valve lift.

To accomplish another object of the present invention, there is provided a variable valve lift system using the above cylinder deactivation system for a vehicle in accordance with the present invention, the system comprising: a protruding end for low lift formed at the front portion of the latching pin: and a stepped portion for high lift established on the bottom of the protruding end in the backward direction, the protruding ends for low lift being caught by the rocker arm to operate the valve at low lift when a regular oil pressure operates through the oil supply hole, whereas, the stepped portions for high lift being caught by the rocker arm to operate the valve at high lift when the oil pressure does not operate.

In addition, the oil pressure operating through the oil supply hole is smaller than that of the cylinder deactivation system so as not to separate the rocker arm from the middle arm.

Meanwhile, as still another exemplary embodiment the cylinder deactivation system for a vehicle comprises: a through-hole formed on the front bottom of the middle arm; a cylindrical lathing pin inserted into the through-hole; a return spring established in the rear of the latch pin to elastically support the latching pin in the horizontal direction; and a spring support portion including a projection projected forward to support the return spring.

Moreover, the rocker arm is established at both sides thereof in parallel at a fixed interval to operate two valves, and the front bottom of the rocker arm is connected with a U-shaped connecting bracket to operate in a body, and a fastening recess is established in the middle portion of the connecting bracket, on which the latching pin is protruded by the return spring so that the rocker arm and the middle operate in a body, whereas, if the front end of the latching pin is moved in the backward direction (toward the inside of the fastening recess) by receiving the oil pressure, the rocker arm and the middle arm operate separated from each other.

Furthermore, the latching pin comprises a piston inserted into the through-hole and moving in the forward and backward directions and a fastening end protruding in the radial direction on the circumference of the rear end of the piston.

In addition, the oil pressure operates through the oil supply hole and an oil groove, of which one end is interconnected with the oil supply hole on the inner circumferential surface of the rear portion of the middle arm and the other end is formed inclinedly so that the oil is supplied from the one end to the front of the protruding portion of the latching pin.

DETAILED DESCRIPTION OF THE INVENTION

Figure 1:
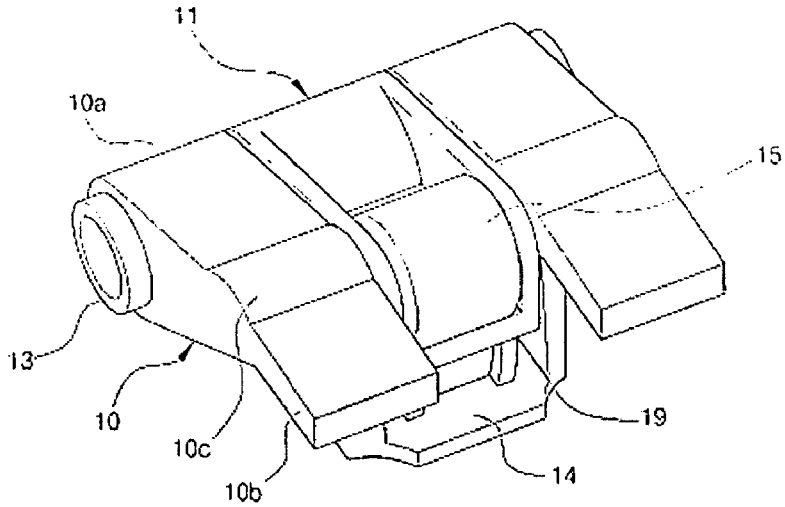
FIG. 1 is a perspective view depicting an exemplary embodiment of a cylinder deactivation system for a vehicle in accordance with the present invention.
Figure 2:
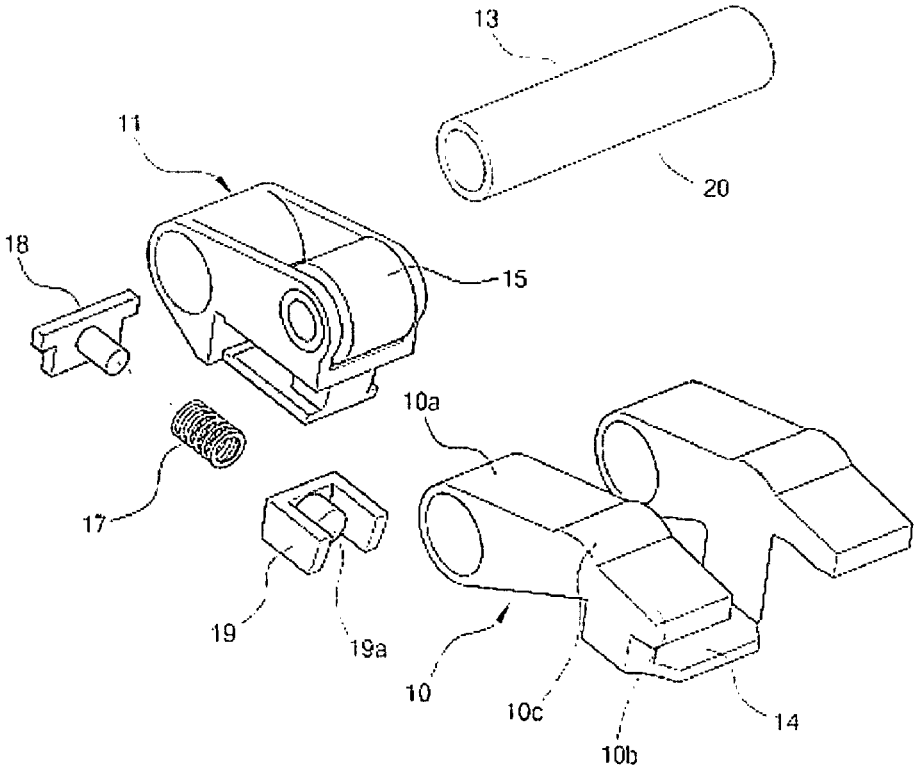
FIG. 2 is an exploded perspective view depicting an exemplary embodiment of a cylinder deactivation system in accordance with the present invention.
Figure 3:
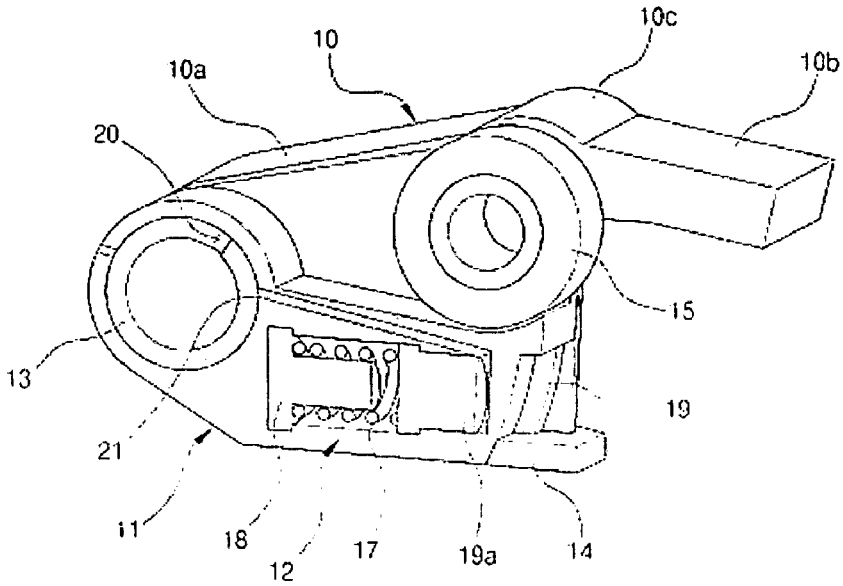
FIG. 3 is a sectional view illustrating an operation state of the cylinder deactivation system in accordance with an exemplary embodiment of the present invention when oil pressure operates.
Figure 4:
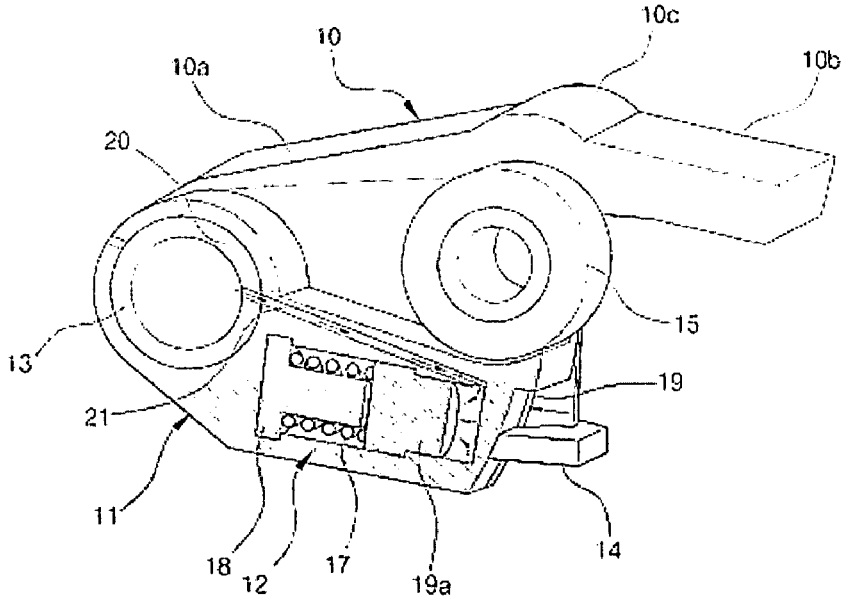
FIG. 4 is a sectional view illustrating an operation state of the cylinder deactivation system in accordance with an exemplary embodiment of the present invention when the oil pressure does not operate.

Hereinafter, exemplary embodiments of the present invention will now be described in detail with reference to the attached drawings.

The present invention aims at improving the engine performance using latching portion 12 mounted on an end pivot type rocker arm 10 and a middle arm 11 to vary the valve lifts when an engine rotates at low speed and at high speed.

A cylinder deactivation system in accordance with an exemplary embodiment of the present invention comprises a rocker shaft 13, a rocker arm 10 connecting two valves, and a middle arm 11, of which the rear portion is hinge-connected with the rocker shaft 13, established in the middle of the rocker arm 10. The rocker arm 10 includes a hinge portion 10*a* penetrated by a rocker shaft 13. A valve contact portion 10*b* is formed as its thickness becomes smaller from the hinge portion 10*a* to the front. A zero lift pad 10*c* is provided between the hinge portion 10*a* and the valve contact portion 10*b*. A U-shaped connecting bracket 14 connects two valve contact portions 10*b* at a fixed interval. Here, the zero lift pad 10*c* plays a role of maintaining a valve clearance when there is no valve lift, and a zero lift cam profile is positioned on the top of the zero lift pad 10*c*.

A main bearing 15 is mounted in the front end of the middle arm 11 and a common cam profile is located on the top of the main bearing 15, which are configured to be rolling-contacted with each other always in the region where there is a lift.

Moreover, a latching portion 12, inserted into the bottom of the middle arm 11, includes a spring support portion 18 supporting a return spring 17 and a latching pin 19. Latching pin 19 moves in the forward and backward directions by the oil pressure and the return spring 17 to control the operations of the rocker arm 10 and the middle arm 11.

The spring support portion 18 has a section of T-shape, of which the front portion penetrates the return spring 17 to support the spring and, at the same time, restrict the backward movement of the latching pin 19. The U-shaped latching pin 19 includes a protruding portion 19*a* formed in the middle of the inside bottom thereof in the vertical direction, and the front portion of the return spring 17 supports the rear surface of the latching pin 19.

Oil pressure is supplied to the latching pin 19 through an oil supply hole 20 established at one side of the rocker shaft 13. A hollow portion is formed inside the rocker shaft 13. An oil groove 21 has one end interconnected with the oil supply hole 20 and the other end formed inclinedly from the hinge portion 10*a* of the middle arm 11 to the front end of the protruding portion 19*a* of the latching pin 19.

Operation of a cylinder deactivation system in accordance with an exemplary embodiment of the present invention will be described as follows.

If the oil pressure is not transmitted through the oil groove 21, the latching pin 19 is pressurized forward by the elastic force of the return spring 17, and the front portion of the latching pin 19 protrudes from the middle arm 11 to the connecting bracket 14 of the rocker arm 10, thus moving the middle arm 11 and the rocker arm 10 in a body.

On the contrary, if the oil pressure operates, the latching pin 19 moves backward by the oil introduced through the oil groove 21, and the movements of the rocker arm 10 and the middle arm 11 are separated from each other, thus causing no valve lifts. That is, the middle arm 11 lies in the lost motion that it continuously comes in contact with the cam by the spring connected to the outside, and the rocker arm 10 does not move, thus being in a cylinder deactivation.

With such an arrangement, the number of parts is reduced and the structure and the assemblage are simplified by operating two valves with a single latching system.

Moreover, since the latching pin 19 does not receive the shear force but receives the compressive force, the design is more robust. Furthermore, since the two valves operate at the same time, it is desirable in terms of the manufacturing cost compared with the method of controlling the respective valves.

Furthermore, since it is easy to ensure the oil flow path and its structure is simplified, it is possible to improving the reliability of latching. In addition, since the common cams are always rolling-contacted, it is possible to reduce the mechanical friction.

Figure 9:
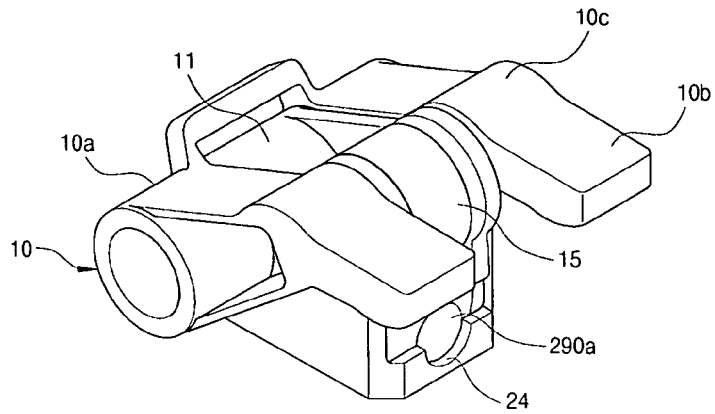
FIG. 9 is a perspective view depicting another embodiment of a cylinder deactivation system for a vehicle in accordance with the present invention.
Figure 10:
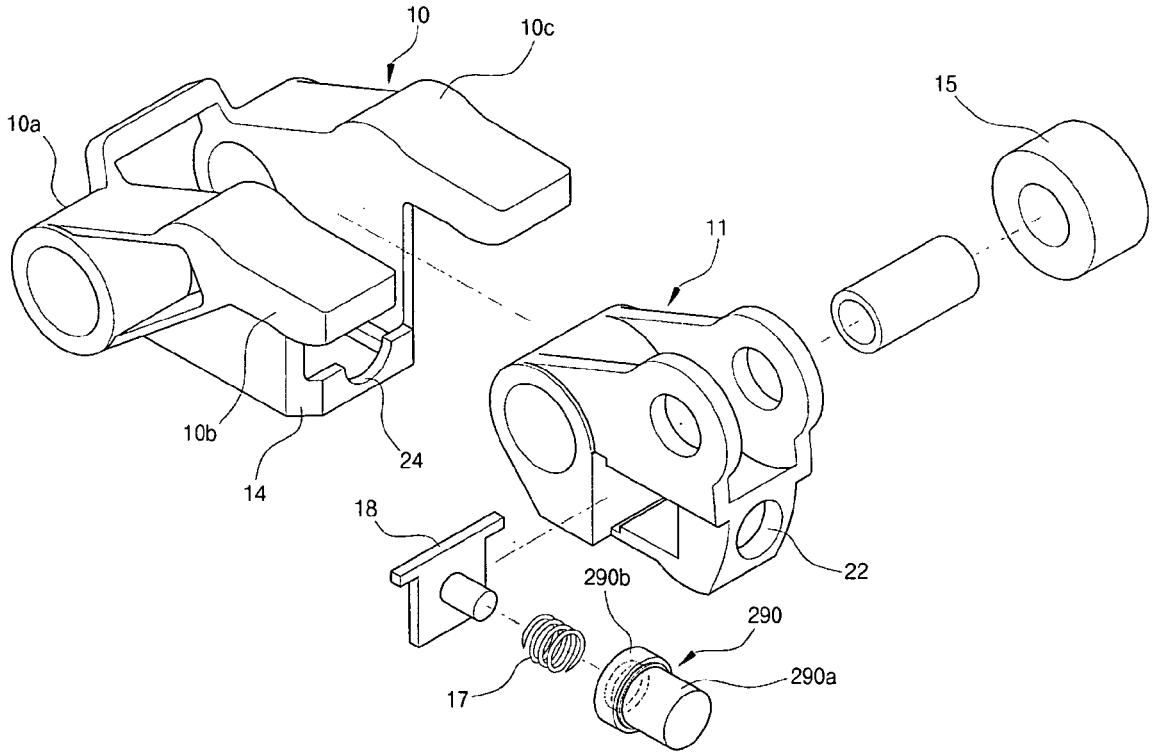
FIG. 10 is an exploded perspective view depicting the cylinder deactivation system of FIG. 9.
Figure 11:
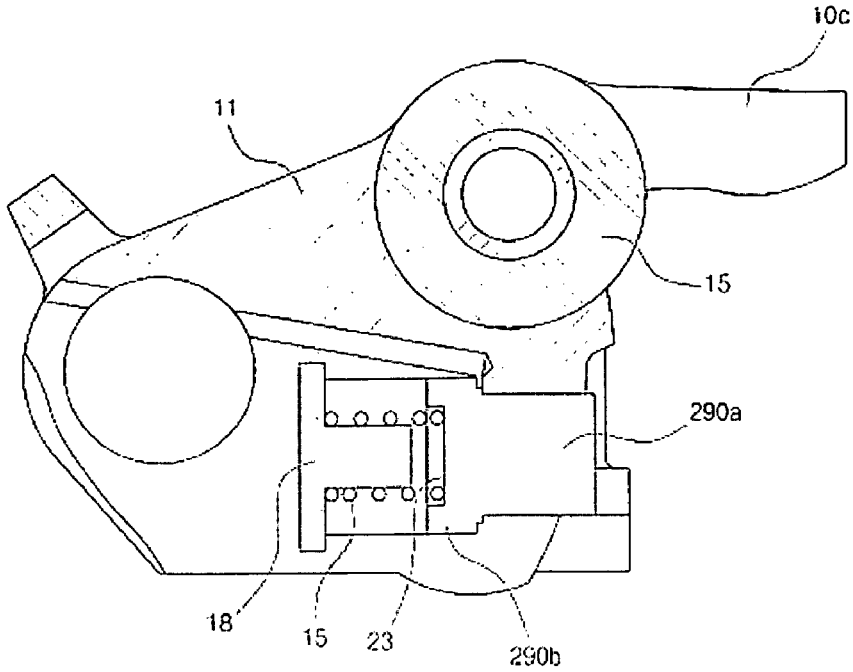
FIG. 11 is a sectional view illustrating an operation state of the cylinder deactivation system of FIG. 9 when oil pressure operates.
Figure 12:
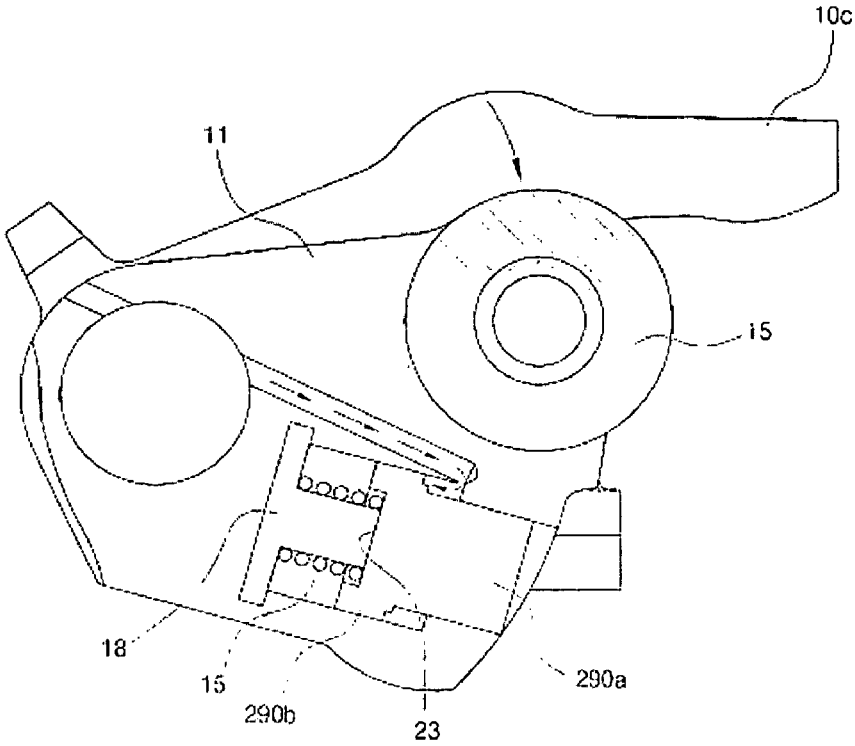
FIG. 12 is a sectional view illustrating an operation state of the cylinder deactivation system of FIG. 9 when the oil pressure does not operate.

As another embodiment of a cylinder deactivation system for a vehicle in accordance with the present invention, the rocker arm 10, the middle arm 11 and the latching portion 12 have the same configuration and operation as the preferred embodiment. The differences from the above-described first embodiment will be described as follows with reference to FIG. 9 et seq.

A space into which the latching portion 12 is inserted is established on the bottom of the middle arm 11 and a cylindrical through-hole 22 is formed on the front bottom of the middle arm. The latching pin 290, established in the form of a cylinder somewhat differently from the first embodiment, comprises a piston 290*a* inserted into the through-hole 22 and moving in the forward and backward directions. A fastening end 290*a* protrudes in the radial direction on the circumference of the rear end of the piston 290*a*. Here, the fastening end 290*b* is elastically supported by the return spring 17 and includes a receiving recess 23, into which the return spring 17 is inserted, formed in the middle of the diameter surface thereof.

A fastening recess 24 is established in the middle portion of the U-shaped connecting bracket 14, on which the front portion of the piston 290*a* is caught when forced outward by the elastic force of the return spring 17. One end of the oil groove 21 is interconnected with the oil supply hole 20 and the other end of the oil groove 21 is formed inclinedly from the hinge portion 10*a* of the middle arm 11 to the front end of the fastening end 290*b* of the latching pin 19. Here, the oil pressure forwarded through the oil supply hole 20 acts in the backward direction in front of the fastening end 290*b*.

If the oil pressure acts on the fastening end 290*b* in the above-described configuration, the fastening end 290*b* moves backward (toward the rocker shaft) so that the piston 290*a* is escaped from the fastening recess 24 to separate the middle arm 11 from the rocker arm 10, thus causing no valve lifts. On the contrary, if the oil pressure does not act on the fastening end 290*b*, the fastening end 290*b* is pushed forward by the elastic force of the compressed return spring 17 and thereby the front portion of the piston 290*a* is caught on the fastening recess 24 to operate the middle arm 11 and the rocker arm 10 in a body, thus moving two valves at the same time by the main bearing 15 coming in contact with the cams.

Figure 5:
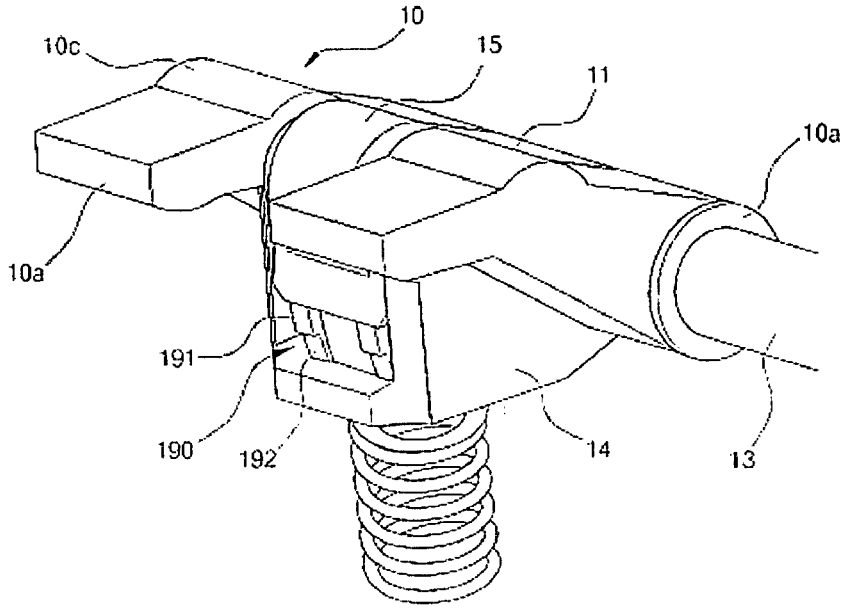
FIG. 5 is a perspective view depicting an exemplary embodiment of a variable valve lift system in accordance with the present invention.
Figure 6:
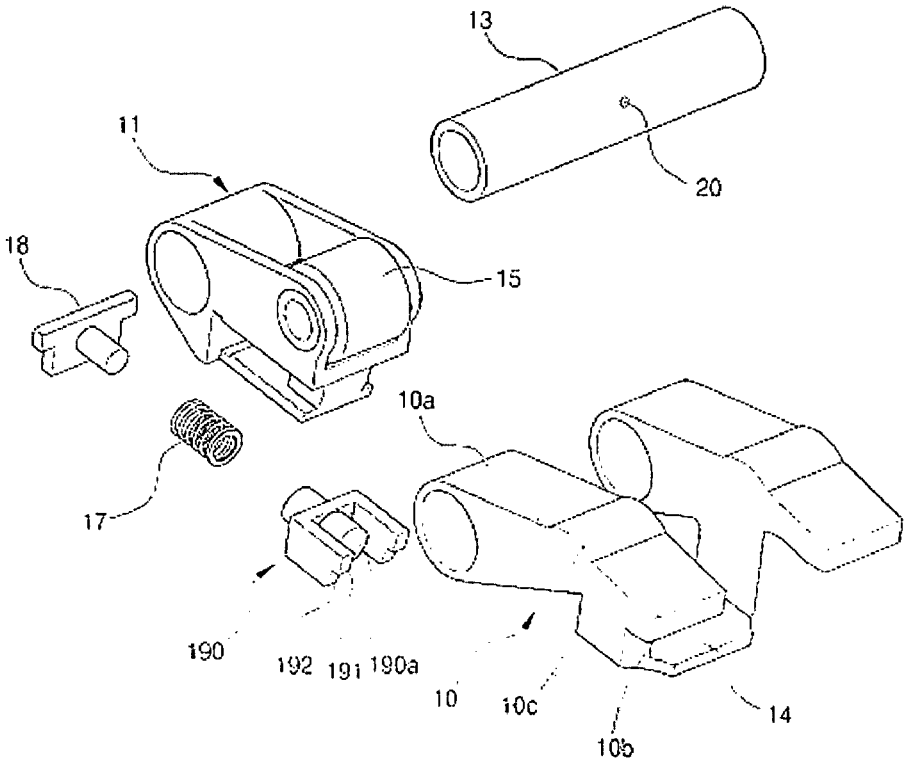
FIG. 6 is an exploded perspective view depicting the variable valve lift system in accordance an exemplary embodiment of with the present invention.

FIGS. 5 and 6 show a variable valve lift system in accordance with another exemplary embodiment of the present invention. The variable valve lift system in accordance with the present invention aims at improving the engine performance by varying the valve to be high lift when the engine rotates at high speed and to be low lift when the engine rotates at low speed in the region where there are lifts to optimize the amount of air breathing. Here, a protruding end 191 for low lift is formed at both front portions of the latching pin 190 used in the variable valve lift system, and a stepped portion 192 for high lift is established on the bottom of the protruding end 191. Oil pressure supplied through a hollow portion of the rocker shaft 13 is controlled by a solenoid valve and regulated by a pressure control valve.

Figure 7:
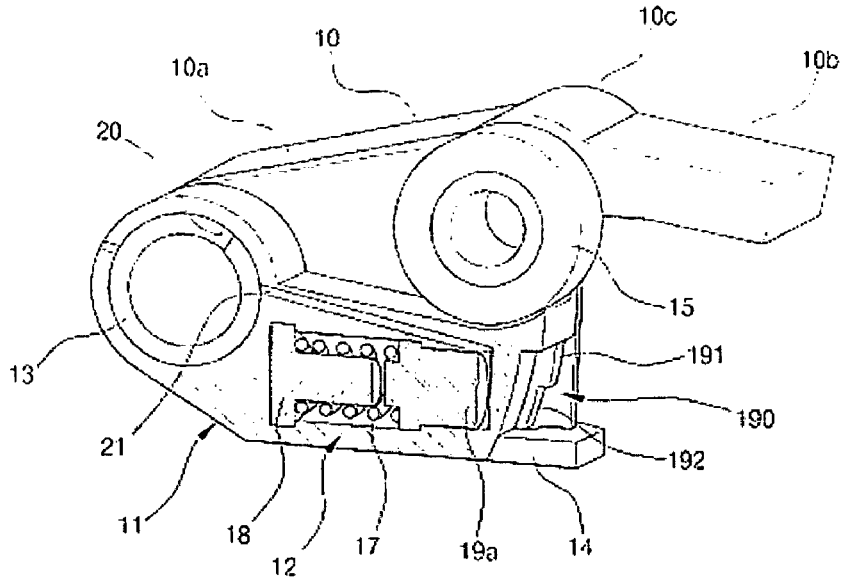
FIG. 7 is a sectional view illustrating an operation state of the variable valve lift system in accordance with an exemplary embodiment of the present invention when the oil pressure operates.
Figure 8:
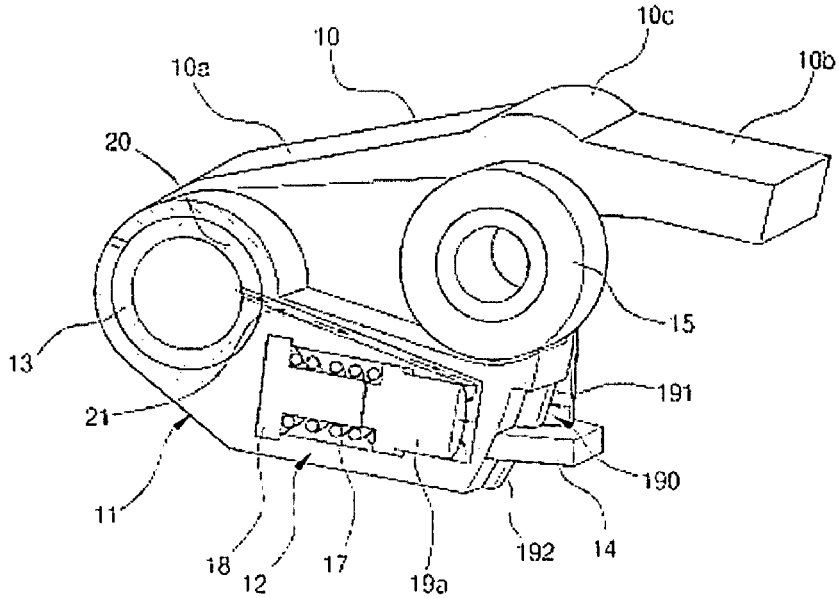
FIG. 8 is a sectional view illustrating an operation state of the variable valve lift system in accordance with an exemplary embodiment of the present invention when the oil pressure does not operate.

The operation state of the variable valve lift system configured as described above in accordance with the present invention will be described as follows with reference to FIGS. 7 and 8, which illustrate the operation state of the variable valve lift system configured as described above in accordance with the present invention.

The cylinder deactivation system is to prevent the rotational force of the cam shaft from being transmitted to the valve as the rocker arm 10 and the middle arm 11 are separated from each other when the oil pressure operates in the latching portion. The variable valve lift system is to vary the valve to be high lift or low lift, when the oil pressure smaller than the oil pressure operates to the extent that the rocker arm 10 and the middle arm 11 are not separated from each other when the engine rotates at low speed, or when the oil pressure does not operates as the protruding ends 191 of the latching pin 190 are caught by the connecting bracket 14 of the rocker arm 10.

If the oil pressure is not transmitted through the oil groove 21, the latching pin 190 is pressurized forward by the elastic force of the return spring 17, and the front portion of the latching pin 190 protrudes from the middle arm 11 to the connecting bracket 14 of the rocker arm 10, thus moving the middle arm 11 and the rocker arm 10 in a body. Here, the stepped portions 192 for high lift formed in the front end of the latching pin 190 are caught by the connecting bracket 14 of the rocker arm 10. On the contrary, if a predetermined oil pressure operates, the latching pin 190 moves backward by the oil introduced through the oil groove 21, and the protruding ends 191 for low lift formed in the front ends of the latching pin 190 are caught by the connecting bracket 14 of the rocker arm 10, thus decreasing the valve lift. That is, the middle arm 11 lies in the lost motion that it continuously comes in contact with the cam by the spring connected to the outside, and the rocker arm 10 and the middle arm 11 moves in a body in the low lift state.

With an arrangement as described for this exemplary embodiment, the present invention can improve the engine performance by applying a simplified latching pin 190 to vary the valve lifts when the engine rotates at low speed and at high speed.

As described above, the cylinder deactivation system for a vehicle and the variable valve lift system using the same in accordance with the present invention have the following advantages.

(1) The number of parts is reduced and the structure and the assemblage are simplified by operating two valves with a single latching system.

(2) Since the latching pin does not receive the shear force but receives the compressive force, it is advantageous to the robust design. Moreover, since the two valves operate at the same time, it is desirable in terms of the manufacturing cost compared with the method of controlling the respective valves.

(3) Since it is easy to ensure the oil flow path and its structure is simplified, it is possible to improving the reliability of latching. Furthermore, since the common cams are always rolling-contacted, it is possible to reduce the mechanical friction.

(4) It is possible to improve the engine performance by applying the protruding ends for low lift of a simplified structure to the front end of the latching pin to vary the valve lifts when the engine rotates at low speed and at high speed.

As above, preferred embodiments of the present invention have been described and illustrated, however, the present invention is not limited thereto, rather, it should be understood that various modifications and variations of the present invention can be made thereto by those skilled in the art without departing from the spirit and the technical scope of the present invention as defined by the appended claims.

What is claimed is:

1. A cylinder deactivation system for a vehicle, comprising:

a rocker shaft having an oil supply hole;

a rocker arm, of which the rear portion is hinge-connected with the rocker shaft so that the front portion thereof drives a valve;

a middle arm, in which a bearing is mounted in the front portion thereof to rolling-contact with a cam and the rear end thereof is hinge-connected with the rocker shaft; and a latching portion separating the rocker arm from the middle arm when an oil pressure operates through the oil supply hole;

wherein the latching portion comprises:

a spring support portion inserted into the bottom of the bearing mounted in the front end of the middle arm and including a projection projected forward;

a return spring penetrated and supported by the projection; and a latching pin, of which the rear portion is supported elastically by the return spring and the front portion is curved from both ends of the rear portion in the forward direction.

2. The cylinder deactivation system for a vehicle as recited in claim 1, wherein a hollow portion is formed inside the rocker shaft to allow the oil to flow and the oil supply hole is established on the rocker shaft, to which the middle arm is hinge-connected.

3. The cylinder deactivation system for a vehicle as recited in claim 1, wherein the rocker arm is established at both sides thereof in parallel at a fixed interval to operate two valves and the front bottom of the rocker arm is connected with a U-shaped connecting bracket.

4. The cylinder deactivation system for a vehicle as recited in claim 1, wherein the latching portion, installed on the bottom of the bearing in the front end of the middle arm, for allowing the middle arm and the rocker arm to operate separated from each other or to operate in a body by the oil pressure.

5. The cylinder deactivation system for a vehicle as recited in claim 1, wherein the front portion of the latching pin is formed curvedly and a protruding portion is formed in the middle of the rear portion thereof in the vertical direction.

6. The cylinder deactivation system for a vehicle as recited in claim 5, wherein the oil pressure operates through the oil supply hole and an oil groove, of which one end is interconnected with the oil supply hole on the inner circumferential surface of the rear portion of the middle arm and the other end is formed inclinedly so that the oil is supplied from the one end to the front of the protruding portion of the latching pin.

7. The cylinder deactivation system for a vehicle as recited in claim 1, wherein the rocker arm includes a hinge portion formed to be hinge-connected with the rocker shaft, a valve contact portion, of which the front portion is formed to drive the valve, and a zero lift pad established between the hinge portion and the valve contact portion to maintain a valve clearance if there is no valve lift.

8. A variable valve lift system using the cylinder deactivation system for a vehicle of claim 1, the system comprising:

a protruding end for low lift formed at the front portion of the latching pin: and a stepped portion for high lift established on the bottom of the protruding end in the backward direction, the protruding ends for low lift being caught by the rocker arm to operate the valve at low lift when a regular oil pressure operates through the oil supply hole, whereas, the stepped portions for high lift being caught by the rocker arm to operate the valve at high lift when the oil pressure does not operate.

9. The variable valve lift system using the cylinder deactivation system for a vehicle as recited in claim 8, wherein the oil pressure operating through the oil supply hole is smaller than that of the cylinder deactivation system so as not to separate the rocker arm from the middle arm.

10. A cylinder deactivation system for a vehicle, comprising:

a rocker shaft having an oil supply hole;

a rocker arm, of which the rear portion is hinge-connected with the rocker shaft so that the front portion thereof drives a valve;

a middle arm, in which a bearing is mounted in the front portion thereof to rolling-contact with a cam and the rear end thereof is hinge-connected with the rocker shaft; and a latching portion separating the rocker arm from the middle arm when an oil pressure operates through the oil supply hole;

wherein the system further comprises:

a through-hole formed on the front bottom of the middle arm;

a cylindrical lathing pin inserted into the through-hole;

a return spring established in the rear of the latch pin to elastically support the latching pin in the horizontal direction; and a spring support portion including a projection projected forward to support the return spring.

11. The cylinder deactivation system for a vehicle as recited in claim 10, wherein:

the rocker arm is established at both sides thereof in parallel at a fixed interval to operate two valves, and the front bottom of the rocker arm is connected with a U-shaped connecting bracket to operate in a body, and a fastening recess is established in the middle portion of the connecting bracket, on which the latching pin is protruded by the return spring so that the rocker arm and the middle operate in a body, whereas, if the front end of the latching pin is moved in the backward direction (toward the inside of the fastening recess) by receiving the oil pressure, the rocker arm and the middle arm operate separated from each other.

12. The cylinder deactivation system for a vehicle as recited in claim 11, wherein the oil pressure operates through the oil supply hole and an oil groove, of which one end is interconnected with the oil supply hole on the inner circumferential surface of the rear portion of the middle arm and the other end is formed inclinedly so that the oil is supplied from the one end to the front of the protruding portion of the latching pin.

13. The cylinder deactivation system for a vehicle as recited in claim 10, wherein the latching pin comprises a piston inserted into the through-hole and moving in the forward and backward directions and a fastening end protruding in the radial direction on the circumference of the rear end of the piston.

* * * * *